US008425392B2

(12) United States Patent
Richards

(10) Patent No.: US 8,425,392 B2
(45) Date of Patent: Apr. 23, 2013

(54) BROADSHEET NEWSPAPER PRINTING PRESS AND FOLDER

(75) Inventor: John Sheridan Richards, Barrington, NH (US)

(73) Assignee: Goss International Americas, Inc., Durham, NH (US)

( * ) Notice: Subject to any disclaimer, the term of this patent is extended or adjusted under 35 U.S.C. 154(b) by 1204 days.

(21) Appl. No.: 11/318,982

(22) Filed: Dec. 27, 2005

(65) Prior Publication Data

US 2007/0161486 A1 Jul. 12, 2007

(51) Int. Cl.
*B31F 1/10* (2006.01)

(52) U.S. Cl.
USPC ..... 493/432; 493/425; 493/427; 493/429

(58) Field of Classification Search ..... 493/405, 493/416, 417, 424, 425–429, 432, 436, 442, 493/454
See application file for complete search history.

(56) References Cited

U.S. PATENT DOCUMENTS

| | | | | |
|---|---|---|---|---|
| 4,578,052 | A | 3/1986 | Engel et al. | 493/11 |
| 5,522,586 | A * | 6/1996 | Bennett et al. | 270/8 |
| 5,571,069 | A | 11/1996 | Shah | 493/357 |
| 5,676,630 | A | 10/1997 | Mayr | |
| 6,010,122 | A * | 1/2000 | Weber | 270/41 |
| 6,024,682 | A | 2/2000 | Mandel et al. | 493/23 |
| 6,038,974 | A * | 3/2000 | Richards | 101/232 |
| 6,082,724 | A | 7/2000 | Kahlig et al. | 270/52.14 |
| 6,279,890 | B1 | 8/2001 | Tomczak | 270/21.1 |
| 6,322,487 | B1 * | 11/2001 | Dufour | 493/424 |
| 6,367,792 | B1 | 4/2002 | Chagnon | 270/5.02 |
| 6,606,944 | B1 | 8/2003 | Athans et al. | 101/224 |
| 6,688,224 | B2 | 2/2004 | Herda et al. | 101/227 |
| 6,733,431 | B2 * | 5/2004 | Dufour | 493/428 |
| 6,752,751 | B2 | 6/2004 | Jackson et al. | 493/428 |
| 6,935,234 | B2 | 8/2005 | Walczak et al. | 101/142 |
| 2002/0145244 | A1 * | 10/2002 | Sappal et al. | 270/49 |
| 2004/0014580 | A1 * | 1/2004 | Kitai et al. | 493/432 |

FOREIGN PATENT DOCUMENTS

| | | |
|---|---|---|
| JP | 62-07174 | 3/1987 |
| JP | 06-255881 | 9/1994 |
| JP | 2003-530283 | 10/2003 |

* cited by examiner

*Primary Examiner* — Christopher Harmon
(74) *Attorney, Agent, or Firm* — Davidson, Davidson & Kappel, LLC

(57) ABSTRACT

A broadsheet newspaper printing press has at least one print unit printing at least one web of material and a folder. The folder has a cross-cutter to cut the web of material into broadsheet newspapers, a tucker cylinder having a gripper gripping the broadsheet newspapers at a lead edge and a tucking blade for forming a cross-fold in the broadsheet newspapers, and a jaw cylinder or fold rollers to receive the cross-folded broadsheet newspapers from the tucker cylinder at the cross-fold, the gripper being located with respect to the tucking blade so that the cross-fold is located at between 33% and 45% or 55% and 67% of the height of the newspaper.

18 Claims, 4 Drawing Sheets

BROADSHEET NEWSPAPER PRINTING PRESS AND FOLDER

BACKGROUND OF THE INVENTION

The present invention relates generally to newspaper printing presses and folders, and to a broadsheet newspaper.

U.S. Pat. No. 6,935,234 discloses a newspaper printing press and is hereby incorporated by reference herein described below.

An unfolded Berliner or midi format newspaper normally measures about 470 mm (18.5 inches) in height and 315 mm (12.0 to 12.5 inches) in width. Several European newspapers, including Le Monde, La Vanguardia, and La Repubblica use this format. As opposed to tabloids, it is generally cross-folded. The fold is generally at the midpoint of the height, i.e. at 335 mm.

U.S. Pat. Nos. 6,367,792, 6,688,224, 6,733,431 and 6,752,751 disclose folders, and are hereby incorporated by reference herein. U.S. Pat. No. 6,082,724 discloses an inserter for placing inserts in a newspaper jacket.

BRIEF SUMMARY OF THE INVENTION

The present invention provides a broadsheet newspaper printing press comprising:

at least one print unit printing at least one web of material; and a folder having:

a cross-cutter to cut the web of material into broadsheet newspapers, a tucker cylinder having a gripper gripping the broadsheet newspapers at a lead edge and a tucking blade for forming a cross-fold in the broadsheet newspapers, and a jaw cylinder or folding rollers to receive the cross-folded broadsheet newspapers from the tucker cylinder at the cross-fold, the gripper being located with respect to the tucking blade so that the cross-fold is located at between 33% and 45% or 55% and 67% of the height of the newspaper.

By having the cross-fold off-center at these distances, variable format broadsheet newspapers with a longer side can be created which permit inserts even with smaller sized broadsheet newspapers.

In a preferred embodiment, the broadsheet newspaper is a Berliner format newspaper of a height of about 18 and one half inches, and the distance between the pin edge of the product and the tucker blade is approximately 8 inches or less and the distance between the tucker blade and the non-pin edge of the product is 10.5 inches or more. Thus standard inserts of 10 and one half inches can be inserted into the Berliner format newspaper without sticking out.

The present invention also provides a folder as described above.

The present invention also provides a Berliner format broadsheet newspaper having a height of approximately 18 and one half inches and a cross fold at approximately 8 inches.

BRIEF DESCRIPTION OF THE DRAWINGS

A preferred embodiment of the present invention is described below by reference to the following drawings, in which.

DETAILED DESCRIPTION OF A PREFERRED EMBODIMENT

Figure 1:
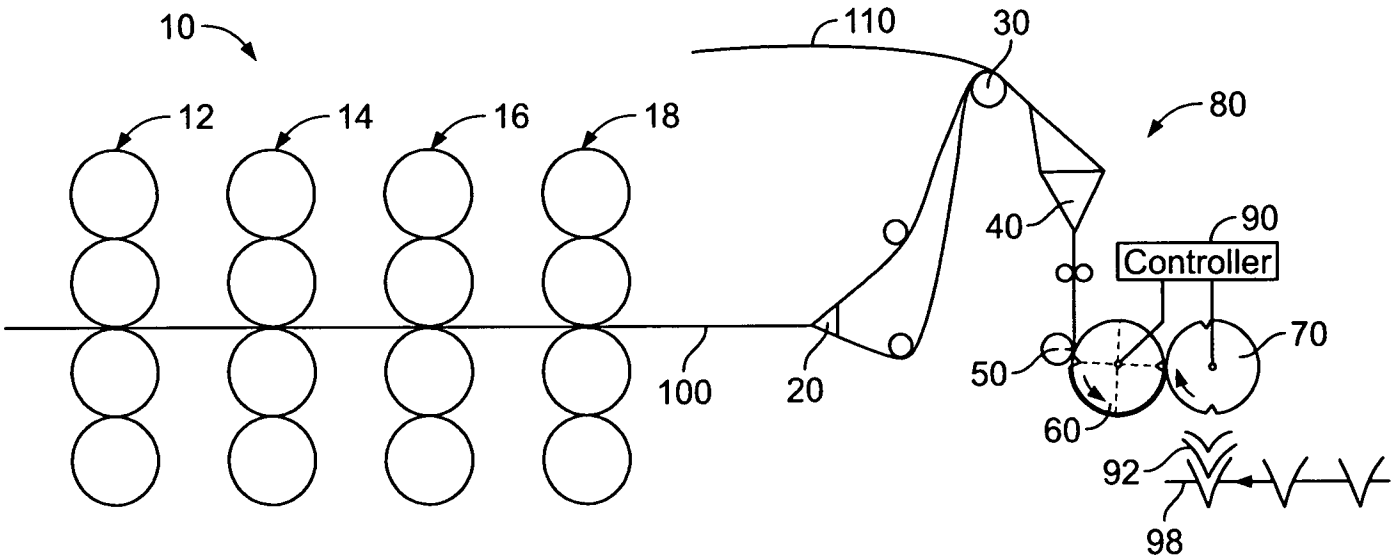
FIG. 1 shows schematically a broadsheet newspaper printing press according to the present invention.

FIG. 1 schematically a broadsheet newspaper printing press having a printing section 10 which may be for example an offset lithographic web printing section with cyan, magenta, yellow and black printing units 12, 14, 16, 18 printing a web 100.

The web may be slit by a slitter 20 into ribbons which are recombined, potentially with other ribbons 110, at a roller 30. The ribbons of the web 100 then enter a folder 80 where they pass to a former board 40 for folding the ribbons longitudinally. A cross cutter 50 of the folder 80 then cuts the ribbons into broadsheet newspapers, which are gripped at a lead edge by a tucker cylinder 60. The tucker cylinder 60 grippers may be for example a hold-down device for pinless gripping or pins.

The newspapers 92 are then tucked and cross-folded into a jaw cylinder 70 and then released to, for example, to a fan wheel, and then to a belt conveyor and a gripper pick-up, and then delivered to a pocket conveyor 98, only the pocket conveyor being shown here for simplicity. The fan wheel and belt conveyor are shown for example in U.S. Pat. No. 6,733,341, hereby incorporated by reference herein.

A controller 90 can set the phasing between the grippers and tuckers of the cylinder 60, and control the phasing of jaws of cylinder 70, so that the cross-fold distance can be set. Owing to the phasing control, the cross-fold can be set between 33% and 45% or 55% and 67% of the height of the newspaper. The offset of at least 5% advantageously can permit smaller format newspapers to still receive standard inserts for example by providing a longer side. Moreover, folder spiders can provide this phasing, while further off-center cross folds may be difficult to achieve with current folder technology.

Figure 2:
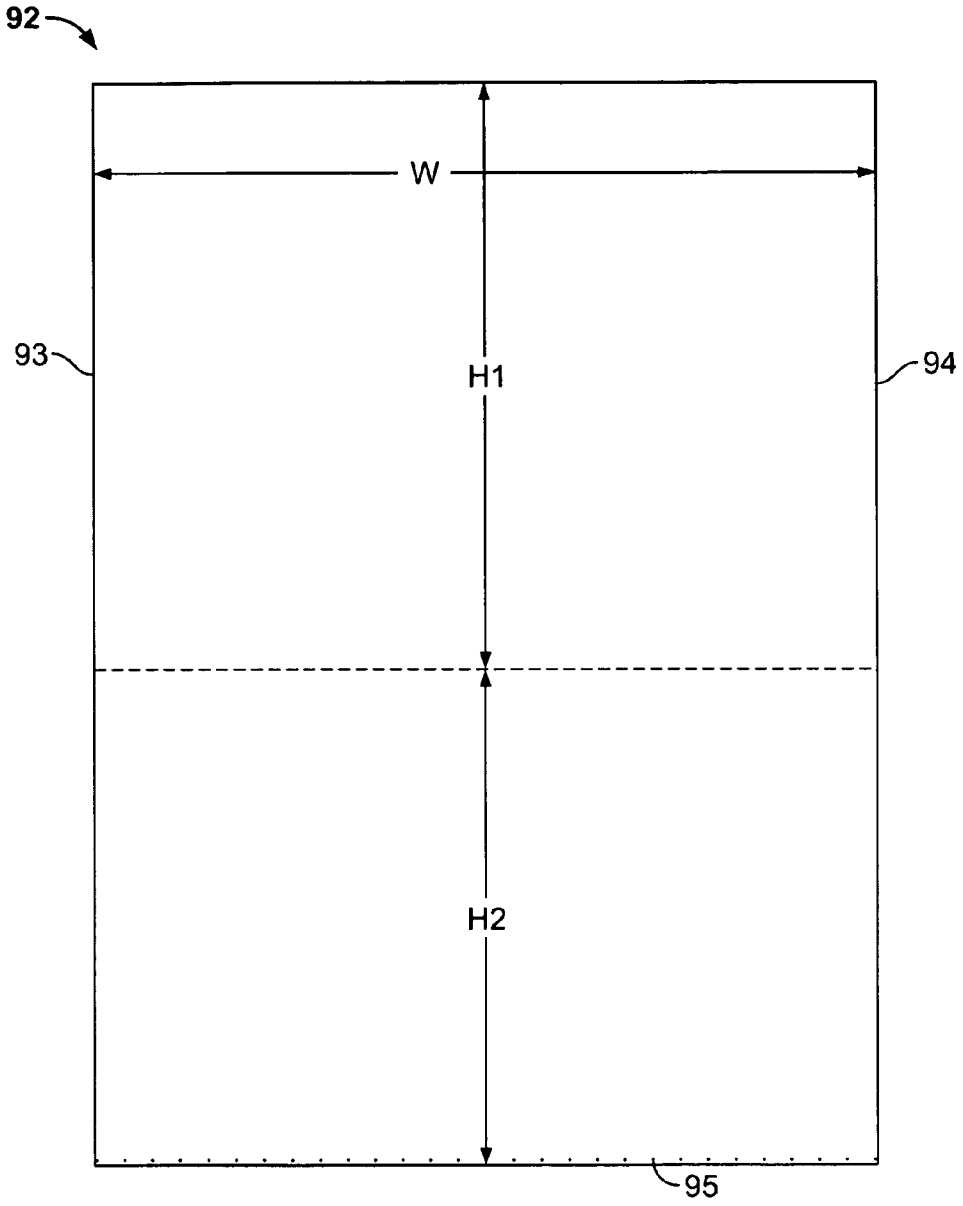
FIG. 2 shows the Berliner format broadsheet newspaper according to the present invention.

FIG. 2 shows a Berliner format broadsheet newspaper 92 folded at the dashed line with the folder of the present invention. H1 is at 10.5 inches or 56.8% and H2 at 8 inches or 43.2% of the newspaper height. The width may be between 12 and 12.5 inches for example. The edge 95 may be for example the pinned or gripped lead edge, the edge 93 the longitudinally folded edge, and the edge 94 the edge opposite the longitudinally folded edge.

The newspaper could be printed such that the H1 section appears with the headline, with for example inserts behind. However, the H2 section could appear with the headline, i.e. the extra 2.5 inches would be at the rear and provide for example advertising space. However, 10.5 inch inserts would cover the advertising space in that embodiment.

Figure 3:
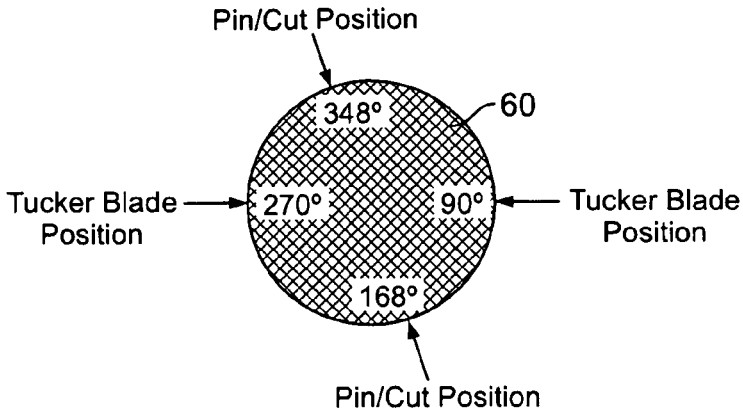
FIGS. 3, 4 and 5 show various pin and tucker blade positions for a tucker cylinder of the folder of the present invention.
Figure 4:
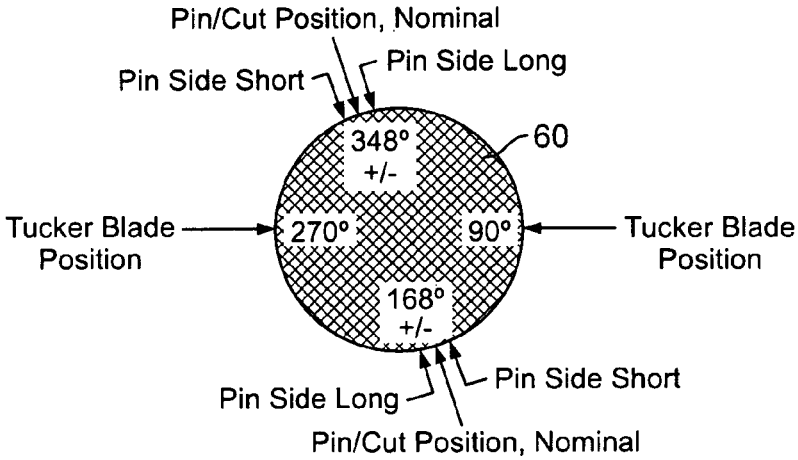
Figure 5:
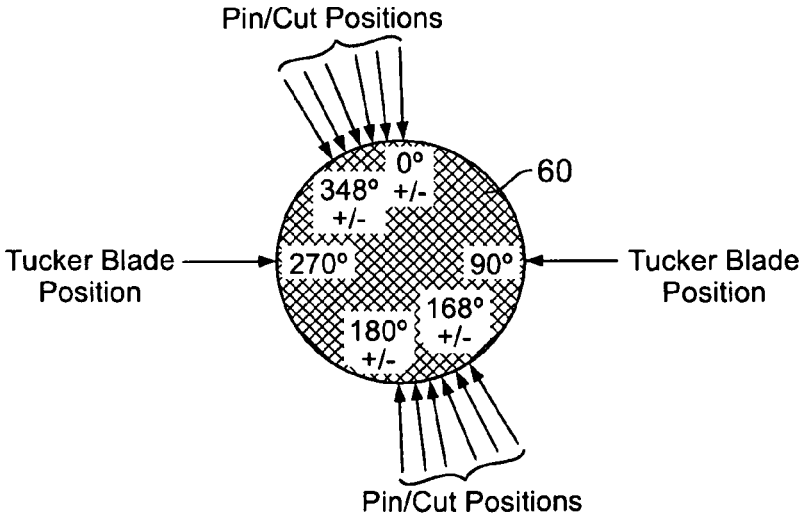

FIG. 3 shows possible pin cut positions for a tucker cylinder 60 with two grippers and two tuckers. This cylinder for example may have a circumference of approximately 37 inches, so that the grippers and tuckers could be located at the angles noted. For example, the phasing of 78 degrees would provide the 8 inch/10.5 inch fold for a Berliner newspaper. The controller 90 can adjust the phasing between the grippers and tuckers as shown in FIG. 4 to adjust the fold between 33% and 45% or 55% and 67%, and also can adjust the folder back to 90 degree offsets if the folder were to be used again for normal 50% folds as shown in FIG. 5.

Figure 6:
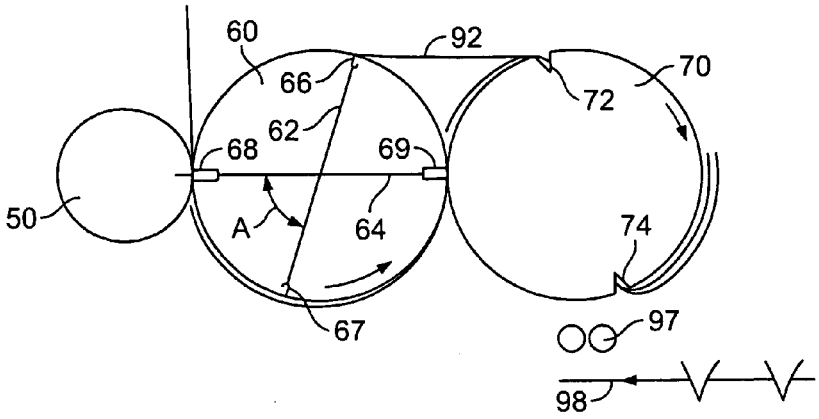
FIG. 6 shows a side view of the folder of the present invention.

FIG. 6 shows the folder with a tucker cylinder 60 having two pins 68, 69 on a spider or gripper support 64, and two tuckers 66, 67 actuated by a tucker support 62 located an angle A, for example approximately seventy-eight degrees, apart from the gripper support 64 in this embodiment. The cross cutter 50 cuts the web, which is pinned by pins 68. Cylinder 60 then rotates until a tucker 67 interacts with a jaw 74 of jaw cylinder 70, while tucker 66 interacts with a jaw 72 of cylinder 70. As jaw cylinder 70 rotates, nip rolls 97, which are optional, can deposit the newspapers in a fan and then on to a conveyors for depositing the newspaper jackets into a pocket conveyor 98 as shown here schematically for example.

Figure 7:
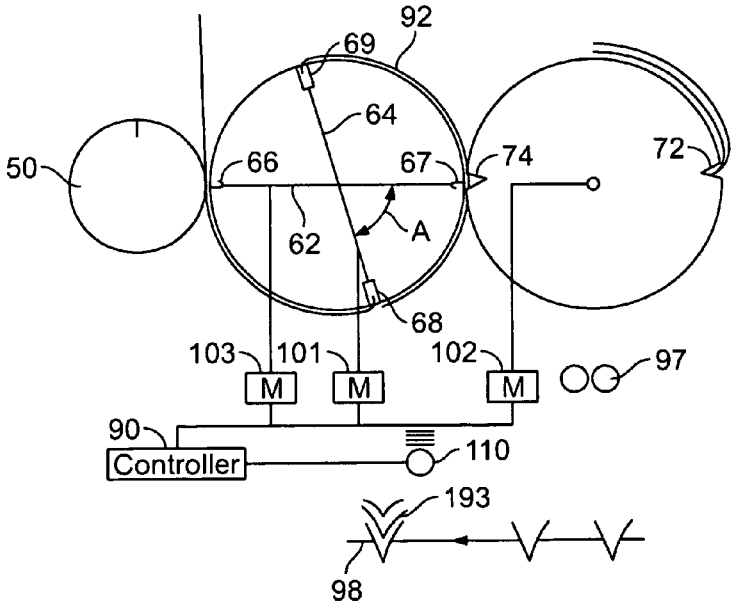
FIG. 7 shows a side view of the folder of the present invention in a further position from the FIG. 6 position.

FIG. 7 shows the folder of FIG. 6 with the jaw 74 receiving newspaper 92 via tuckers 67. The controller 90 can control the phasing of tuckers 67, 66 via servomotor 103 and support 62 to match the phasing of jaws 72, 74 via servomotor 102. Servomotor 101 can be set by controller 90 and control pins or other grippers 68, 69 via support 64. Controller 90 can also control the fan, any subsequent conveyors and an inserter feeder 110 and pocket conveyor 98. Inserts from feeder 110 for example preferably include 10.5 inch inserts. Thus, a Berliner format newspaper with 10.5 inch inserts 193 can be formed.

While the folder has been shown with a tucking cylinder with two grippers and two tuckers, other configurations such as a three gripper or four gripper configuration are possible. Moreover, while the folder has been shown with a tucking cylinder with grippers and tuckers, other configurations such as a folder employing rotary tuckers and folding rollers, a so-called rotary blade folder, is possible. In that case, the jaw cylinder is replaced by folding rollers which receive the folded signatures from a tucker cylinder. U.S. Pat. No. 6,688,224 for example is hereby incorporated by reference herein as showing a rotary blade folder.

What is claimed is:

1. A Berliner broadsheet newspaper printing press comprising:

at least one print unit printing at least one web of material;

a folder having:

a cross-cutter to cut the web of material into Berliner broadsheet newspapers, a tucker cylinder having a gripper gripping the Berliner broadsheet newspapers at a lead edge and a tucking blade for forming a cross-fold in the Berliner broadsheet newspapers, and a jaw cylinder or folding rollers to receive the cross-folded Berliner broadsheet newspapers from the tucker cylinder at the cross-fold, the gripper being located with respect to the tucking blade so that the cross-fold is located approximately 8 inches or 10.5 inches from an edge of the Berliner broadsheet newspaper so as to create a Berliner broadsheet newspaper having one side with a height of at least approximately 10.5 inches a servomotor connected to the jaw cylinder or tucking cylinder or grippers and to a controller, the controller controlling the phasing of the jaw cylinder, tucking cylinder or gripper via the servomotor, the gripper being offset from the tucking blade by about 78 degrees.

2. The printing press as recited in claim 1 wherein the gripper is a pin.

3. The printing press as recited in claim 1 wherein the folder includes the jaw cylinder.

4. The printing press as recited in claim 1 further comprising an inserter for inserting inserts into the Berliner broadsheet newspaper.

5. The printing press as recited in claim 4 wherein the inserts have a dimension of at least 10.5 inches.

6. The printing press as recited in claim 1 wherein the gripper is a gripping jaw.

7. The printing press as recited in claim 1 further comprising a pocket conveyor including a plurality of pockets, the pockets receiving a Berliner broadsheet newspaper so the cross fold is located at a bottom of the pocket.

8. The printing press as recited in claim 7 further comprising an inserter for inserting materials into the Berliner broadsheet newspapers located in the plurality of pockets.

9. The printing press as recited in claim 8 wherein the controller controls the inserter feeder and pocket conveyor.

10. The printing press as recited in claim 1 wherein the tucking cylinder has two pins.

11. The printing press as recited in claim 1 wherein the tucking cylinder has two grippers.

12. The printing press as recited in claim 1 wherein the tucking blade is actuated by a tucker support.

13. A Berliner broadsheet newspaper printing press comprising:

at least one print unit printing at least one web of material; and a folder having:

a cross-cutter to cut the web of material into Berliner broadsheet newspapers, a tucker cylinder having a gripper gripping the Berliner broadsheet newspapers at a lead edge and a tucking blade for forming a cross-fold in the Berliner broadsheet newspapers, the tucking blade being actuated by a tucker support; and a jaw cylinder or folding rollers to receive the cross-folded Berliner broadsheet newspapers from the tucker cylinder at the cross-fold, the gripper being located with respect to the tucking blade so that the cross-fold is located approximately 8 inches or 10.5 inches from an edge of the Berliner broadsheet newspaper so as to create a Berliner broadsheet newspaper having one side with a height of at least approximately 10.5 inches, the gripper being located on a gripper support and the gripper support being offset from the tucker support by about 78 degrees.

14. The printing press as recited in claim 13 wherein the gripper support is a gripper spider.

15. The printing press as recited in claim 13 wherein the gripper is movable with respect to the tucking blade.

16. The printing press as recited in claim 15 further comprising a controller, the controller phasing the gripper and tucking blade.

17. A Berliner broadsheet newspaper printing press comprising:

at least one print unit printing at least one web of material;

a folder having:

a cross-cutter to cut the web of material into Berliner broadsheet newspapers, a tucker cylinder having a gripper gripping the Berliner broadsheet newspapers at a lead edge and a tucking blade for forming a cross-fold in the Berliner broadsheet newspapers, and a jaw cylinder or folding rollers to receive the cross-folded Berliner broadsheet newspapers from the tucker cylinder at the cross-fold, the gripper being located with respect to the tucking blade so that the cross-fold is located approximately 8 inches or 10.5 inches from an edge of the Berliner broadsheet newspaper so as to create a Berliner broadsheet newspaper having one side with a height of at least approximately 10.5 inches, the gripper being movable with respect to the tucking blade, and a controller, the controller phasing the gripper and tucking blade the gripper being offset from the tucking blade by about 78 degrees.

18. The printing press as recited in claim 17 wherein the tucking cylinder has two grippers on a gripper support and two tucking blades on a tucker support, the grippers being located not at a right angle with respect to the tucking blades.

* * * * *